US005444429A

United States Patent [19]

Sakich et al.

[11] Patent Number: 5,444,429

[45] Date of Patent: Aug. 22, 1995

[54] ELECTRICAL ASSEMBLY WITH SURGE ARRESTER AND INSULATOR

[75] Inventors: John D. Sakich, Wadsworth; Michael G. Comber, Medina, both of Ohio

[73] Assignee: Hubbell Incorporated, Orange, Conn.

[21] Appl. No.: 151,979

[22] Filed: Nov. 15, 1993

[51] Int. Cl.[6] ..... H01C 7/10

[52] U.S. Cl. ..... 338/21; 361/117; 361/127

[58] Field of Search ..... 338/20, 21; 361/117, 361/118, 119, 127

[56] References Cited

U.S. PATENT DOCUMENTS

| | | | |
|---|---|---|---|
| 3,172,073 | 3/1965 | Bolton et al. | 338/280 |
| 3,447,118 | 5/1969 | Ferree | 338/21 |
| 4,161,012 | 7/1979 | Cunningham | 361/128 |
| 4,212,696 | 7/1980 | Lusk et al. | 156/294 |
| 4,427,843 | 1/1984 | Ishihara et al. | 174/140 S |
| 4,467,387 | 8/1984 | Bergh et al. | 361/132 |
| 4,656,555 | 4/1987 | Raudabaugh | 361/117 |
| 4,812,944 | 3/1989 | Eberhard et al. | 361/127 |
| 4,814,936 | 3/1989 | Ozawa et al. | 361/127 |
| 4,827,370 | 5/1989 | St. Jean et al. | 361/127 |
| 4,851,955 | 7/1989 | Doone et al. | 361/117 |
| 4,899,248 | 2/1990 | Raudabaugh | 361/127 |
| 4,905,118 | 2/1990 | Sakich | 361/117 |
| 5,159,158 | 10/1992 | Sakich et al. | 174/179 |
| 5,218,508 | 6/1993 | Doone | 361/127 |

*Primary Examiner*—Marvin M. Lateef

*Attorney, Agent, or Firm*—Jerry M. Presson; David L. Tarnoff

[57] ABSTRACT

An electrical assembly having a surge arrester coupled in parallel to an insulator of high mechanical strength for increasing the mechanical strength of the surge arrester. The arrester having a plurality of non-linear resistive blocks positioned between a pair of end fittings and enclosed in a polymeric weathershed housing. The insulator having a reinforced fiberglass rod with a pair of end fittings and covered by a polymeric weathershed housing. The end fittings of the surge arrester and the insulator being rigidly coupled together by a pair of mounting plates for maintaining the surge arrester parallel to the insulator, and thereby increasing the mechanical strength of the arrester.

28 Claims, 9 Drawing Sheets

ELECTRICAL ASSEMBLY WITH SURGE ARRESTER AND INSULATOR

FIELD OF THE INVENTION

The present invention relates to an electrical assembly for high voltage applications having a surge arrester and an insulator. More specifically, this invention relates to an electrical assembly having a surge arrester coupled parallel to an insulator of high mechanical strength for increasing the mechanical strength of the surge arrester.

BACKGROUND OF INVENTION

Surge arresters are used in the electrical power industry for protecting expensive pieces of electrical equipment by limiting the magnitude of surges in voltage. Such surges in voltage often occur, for example, when lightning strikes. When this happens, the surge arrester shunts the surge to the ground, thereby protecting the piece of electrical equipment and the circuit from damage or destruction.

Typically, present day surge arresters commonly include an elongated, hollow cylindrical weathershed housing made of an insulating material such as porcelain or a polymer, a plurality of non-linear resistive blocks stacked within the housing and a conductive member at each end to form a pair of end terminals. The non-linear resistive blocks commonly contain silicone carbide (SiC) or zinc oxide (ZnO), which are usually shaped as relatively short cylinders. These non-linear resistive blocks are stacked end to end within the arrester housing, and held under axial compression between the end terminals. The number of blocks employed is a function of the material (SiC or ZnO) as well as the voltage rating for the assembly. Thus, a surge arrester with a high voltage rating would be longer than a surge arrester with a low voltage rating.

Surge arresters with high voltage ratings are often used to protect outdoor equipment. These high voltage surge arresters are typically base mounted in either a horizontal or vertical position and subjected to cantilever mechanical loads. In particular, these surge arresters are often subjected to severe dynamic mechanical loads caused by various conditions such as high winds, snow, icing, earthquakes, line breakage, etc. Consequently, these surge arresters must be constructed to withstand such extreme mechanical loads. Accordingly, as the application voltage increases, the length of the arrester increases requiring high cantilever strength to withstand the mechanical loads applied thereto by the environment.

Examples of some prior surge arresters are disclosed in Bolton et al U.S. Pat. No. 3,172,073; Ferree U.S. Pat. No. 3,447,118; Bergh et al U.S. Pat. No. 4,467,387; Ozawa et al U.S. Pat. No. 4,814,936; Doone et al U.S. Pat. No. 4,851,955; and Raudabaugh U.S. Pat. No. 4,899,248.

In view of the above, it is apparent that a need exists to provide an electrical assembly which increases the mechanical strength of a surge arrester, especially surge arresters with a high voltage rating. This invention addresses this need in the art along with other needs which will become apparent to those skilled in the art once given this disclosure.

SUMMARY OF THE INVENTION

A primary object of the subject invention is to provide a surge arrester with increased mechanical strength.

A further object of the present invention is to provide an electrical assembly which connects a surge arrester and an insulator of high mechanical strength in parallel to increase the mechanical strength of the arrester.

Another object of the invention is to provide an electrical assembly utilizing components which are relatively inexpensive and simple to manufacture.

Another object of the invention is to utilize a conventional surge arrester with non-linear resistive blocks and a conventional post insulator with a fiberglass reinforced polymer rod coupled in parallel by a pair of mounting plates coupled to the ends of the arrester and insulator.

Still another object of the invention is to provide an electrical assembly utilizing a conventional surge arrester coupled in parallel to a plurality of conventional post insulators to increase the mechanical strength of the arrester.

The foregoing objects are basically attained by an electrical assembly, the combination comprising: a first surge arrester having a core member, a weathershed housing surrounding the core member, a first end fitting coupled to one end of the core member, a second end fitting coupled to the other end of the core member, and a first longitudinal axis extending between the first and second end fittings; a first electrical insulator having an insulated core member, a weathershed housing surrounding the core member of the insulator, a first end fitting coupled to one end of the core member of the insulator, a second end fitting coupled to the other end of the core member of the insulator, and a second longitudinal axis extending between the first and second end fittings of the insulator; and a coupling assembly coupled to the arrester and the insulator for coupling the insulator adjacent to the arrester with the first longitudinal axis of the arrester being arranged substantially parallel to the second longitudinal axis of the insulator.

Other objects, advantages, and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form part of this original disclosure.

DETAILED DESCRIPTION OF THE INVENTION

Figure 1:
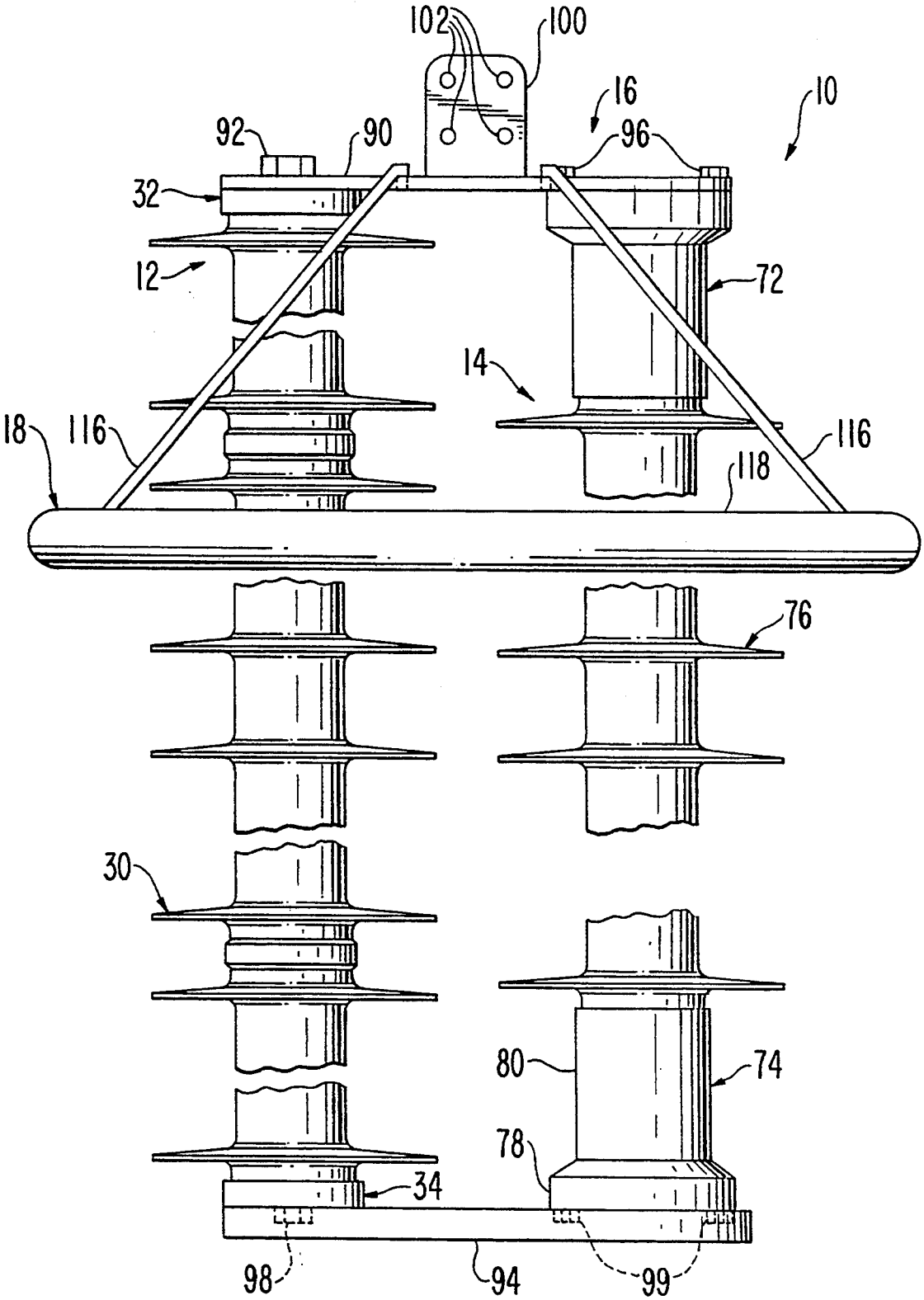
FIG. 1 is a side elevational view of an electrical assembly in accordance with a first embodiment of the present invention illustrating a surge arrester coupled in parallel to an insulator.

Initially referring to FIG. 1, an electrical assembly 10 in accordance with the present invention is illustrated, and includes a surge arrester 12 and insulator 4, a mounting assembly 16 coupling surge arrester 12 in parallel to insulator 14 to enhance the mechanical strength of surge arrester 12, and a conventional grading ring 18 coupled to mounting assembly 16. Specifically, insulator 14 has a higher cantilever or bending strength then the cantilever or bending strength of arrester 12. Thus, the cantilever or bending strength of arrester 12 is increased in electrical assembly 10, since insulator 12 supports and enhances the strength of arrester 12.

Figure 4:
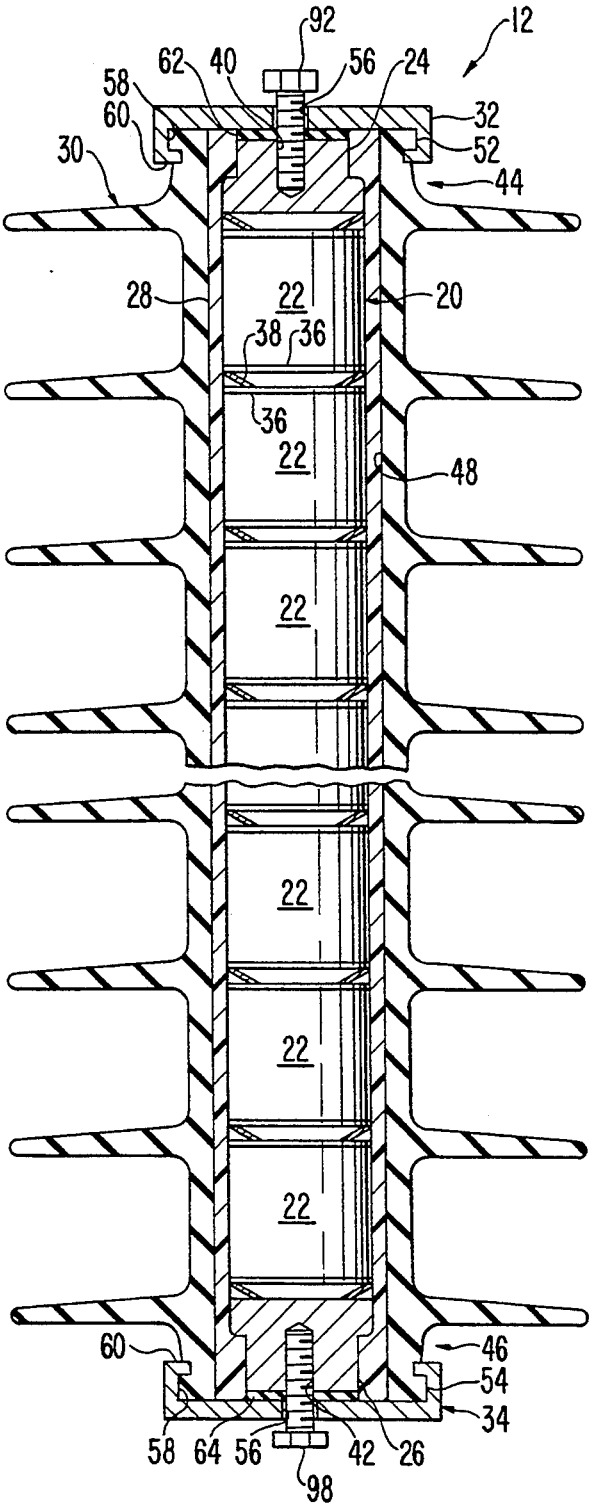
FIG. 4 is an enlarged, partial longitudinal cross-sectional view of the surge arrester illustrated in FIGS. 1–3 before being coupled to the mounting assembly.

As seen in FIG. 4, surge arrester 12 includes a core member 20 formed of a plurality of non-linear resistive blocks 22 and a pair of end terminals 24 and 26 wrapped in a layer of non-conductive filament winding 28, a polymeric weathershed housing 30 overlying core member 20, and a pair of end fittings 32 and 34 coupled to the ends of core member 20 and the ends of weathershed housing 30. The basic construction of surge arrester 12 is discussed in more detail in U.S. Pat. No. 4,905,118, which is hereby incorporated by reference. Typically, a polymeric arrester 12 with non-linear resistive blocks has a usable cantilever strength in the range of approximately 5,000 inch-pounds to approximately 10,000 inch-pounds.

Non-linear resistive blocks 22 are preferably metal oxide varistors (MOV) blocks. Non-linear resistive blocks 22 are stacked end to end and held under an axially-directed compressive force by the non-conductive filament winding 28. Preferably, blocks 22 are shaped as relatively short cylinders. The voltage rating of surge arrester 12 can be increased or decreased by merely adding or subtracting the number of non-linear resistive blocks utilized to form core member 20 of arrester 12. Preferably, a pair of contact disks 36 and a spring washer 38 are positioned between each non-linear resistive block 22.

End terminals 24 and 26 are preferably formed from aluminum or any other suitable conductive material with similar mechanical strength. End terminals 24 and 26 are substantially identical, except that they face in opposite directions. End terminal 24 has a threaded bore 40 for coupling the upper end of surge arrester 12 to the upper end of insulator 14 via mounting assembly 16 as discussed below. Likewise, end terminal 26 has a threaded bore 42 for coupling the lower end of surge arrester 12 to insulator 14 via mounting assembly 16 as discussed below.

Weathershed housing 30 has a first or upper end portion 44 and a second or lower end portion 46 with an axially extending bore 48 extending between upper end portion 44 and lower end portion 46. Bore 48 preferably has a substantial uniform cylindrical inner surface with an internal diameter, which is slightly smaller than or equal to the diameter of core member 20 in its unstressed state. Bore 48 or core member 20 can be coated with a viscous insulating material, such as silicone grease, to prevent the ingress of contaminants along the interface of core member 20 and bore 48 of weathershed housing 30. Weathershed housing 30 is preferably composed of a polymeric, elastomeric material having sufficient resiliency to be expanded radially outwardly upon insertion of core member 20 into axially extending bore 48.

As seen in FIG. 4, upper end portion 44 of weathershed housing 30 has an outwardly extending annular end flange 52 which is coupled to end fitting 32 for sealing the space between weathershed housing 30 and end terminal 24. Likewise, lower end portion 46 of weathershed housing 30 has an outwardly extending annular end flange 54, which is coupled to end fitting 34 for sealing the space between weathershed housing 30 and end terminal 26 as discussed below in more detail.

Figure 7:
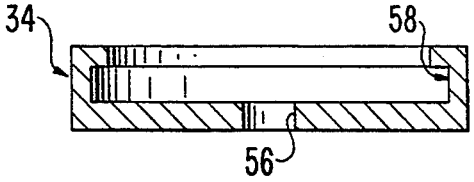
FIG. 7 is an enlarged, cross-sectional view of one of the end fittings of the arrester illustrated in FIGS. 1–4.
Figure 8:
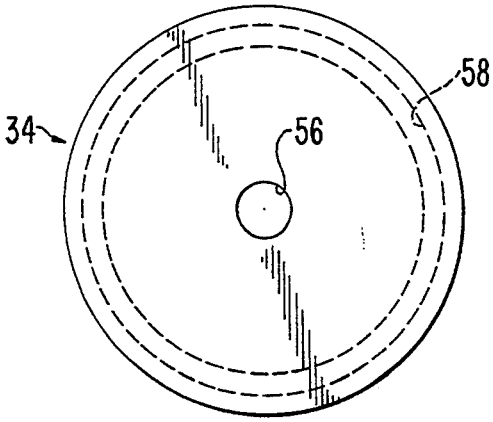
FIG. 8 is an enlarged, bottom end plan view of the surge arrester illustrated in FIG. 7.

End fittings 32 and 34 are substantially identical. As particularly seen in FIGS. 7 and 8, end fitting 34 has an axially extending bore 56, an annular recess 58 for receiving end flange 54 of weathershed housing 30, and an annular flange 60 for engaging the outer surface of weathershed housing 30. Likewise, end fitting 32 has an axially extending bore 56, an annular recess 58 for receiving end flange 52 of weathershed housing 30 and an annular flange 60 for engaging the outer surface of weathershed housing 30. Preferably, end fittings 32 and 34 are made of a metallic material such as aluminum or iron.

The inner diameters of recesses 58 and flanges 60 of end fittings 32 and 34 are smaller than the outer diameter of the corresponding portions of weathershed housing 30 when dilated by core member 20. Accordingly, this causes a seal between the interfaces of end fittings 32 and 34 and the outer surface of weathershed housing 30. Also, gaskets 62 and 64 are positioned between end fittings 32 and 34 and the end terminals 24 and 26 for sealing between end fitting 32 and 34 and end terminals 24 and 26, respectively.

Figure 5:
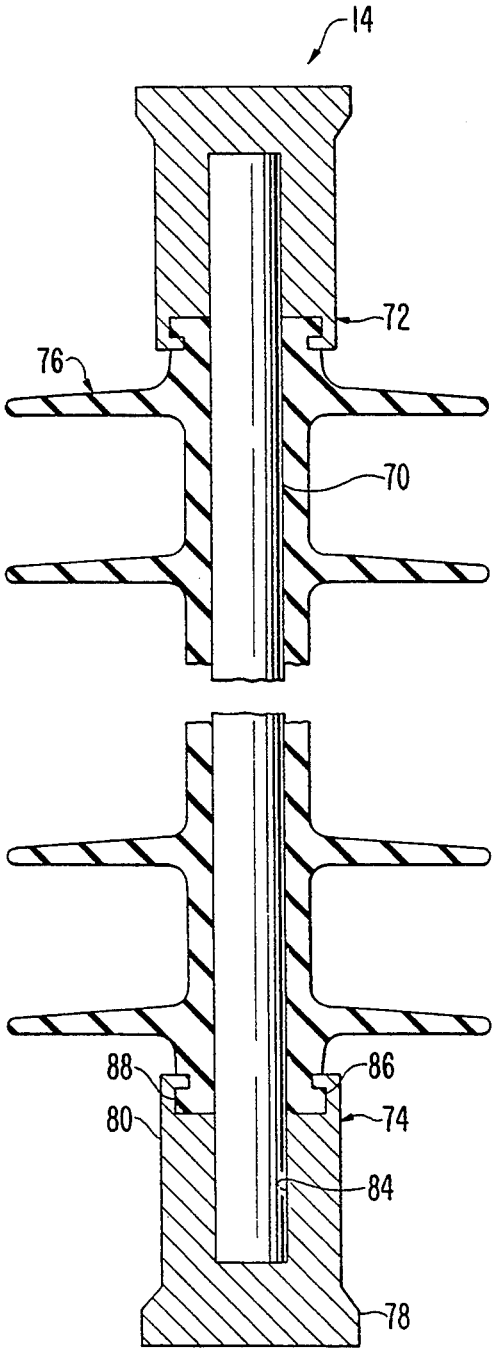
FIG. 5 is an enlarged, partial longitudinal cross-sectional view of the post insulator illustrated in FIGS. 1–3.
Figure 6:
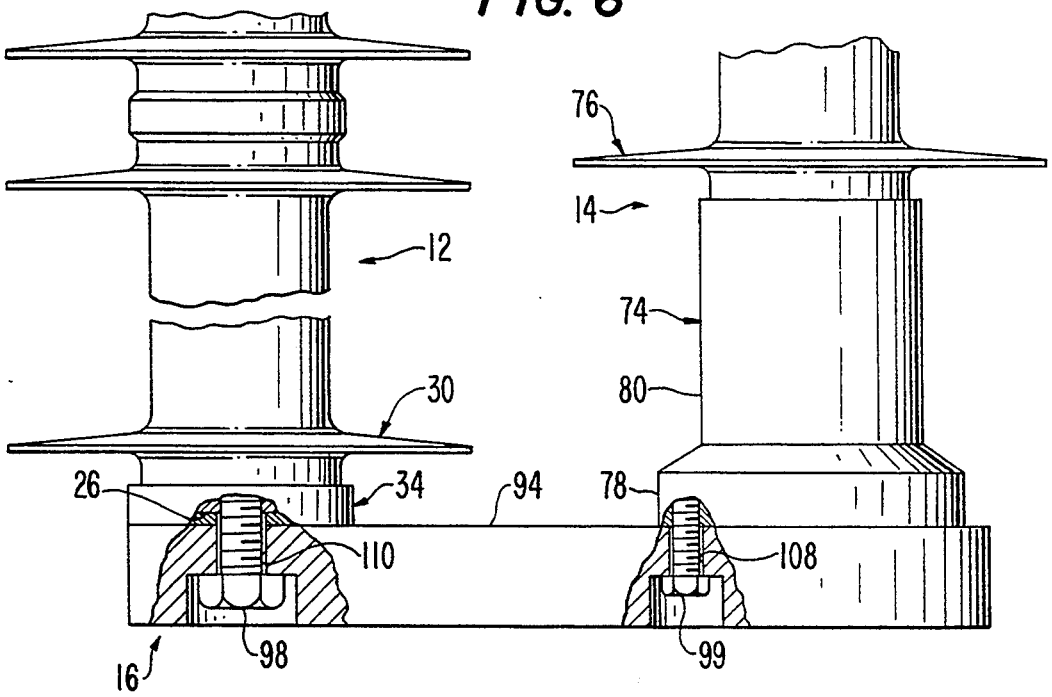
FIG. 6 is an enlarged, partial elevational view of the electrical assembly illustrated in FIGS. 1–3 showing the bottom mounting plate connecting the lower ends of the surge arrester and the insulator together.

As seen in FIG. 5, insulator 14 includes an insulating core member 70, a first end fitting 72 coupled to the upper end of core member 70, a second end fitting 74 coupled to the lower end of core member 70, and an elastomeric weathershed housing 76 overlying and enclosing the portion of core member 70 between end fittings 72 and 74.

Core member 70 is preferably an elongated cylindrical insulating rod, which is composed of fiberglass reinforced epoxy, vinylester or polyester resin. Preferably, core member 70 is a reinforced fiberglass rod with a usable strength of approximately 100,000 inch-pounds or more. Core member 70 has a substantially uniform outer diameter with its upper and lower ends fixedly coupled to end fittings 72 and 74 in a conventional manner, such as crimping. Insulator 14 can be constructed in accordance with U.S. patent application Ser. No. 07/707,892 to Robert A. Bernstorf, filed on May 30, 1992, which is hereby incorporated herein by reference.

Figure 9:
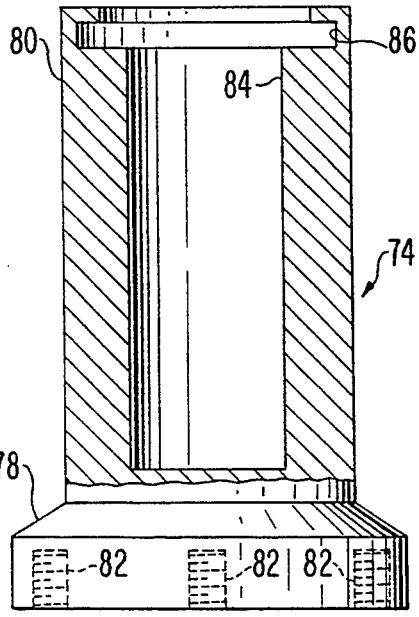
FIG. 9 is an enlarged cross-sectional view of one of the end fittings of the insulator illustrated in FIGS. 5 and 6.
Figure 10:
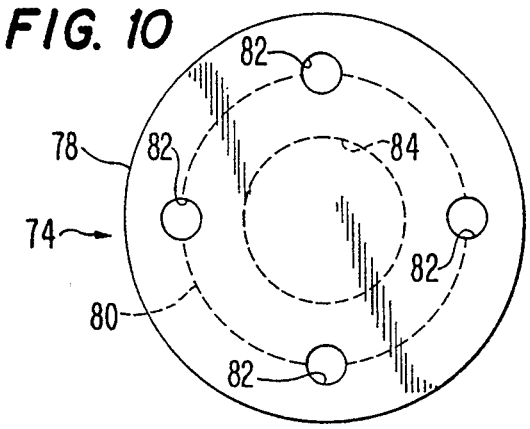
FIG. 10 is an enlarged, bottom end plan view of the end fitting illustrated in FIG. 9.

End fittings 72 and 74 are substantially identical, and thus only second end fitting 74 will be discussed and illustrated in detail herein. As seen in FIGS. 9 and 10, second end fitting 74 includes a base portion 78 and a tubular portion 80 extending perpendicularly from base portion 78. Base portion 78 preferably has four threaded bores 82 for fixedly coupling end fitting 74 to mounting assembly 16 as discussed below. Tubular member 80 has a centrally located axially extending bore 84 for receiving the lower end of core member 70 therein and an annular groove 86 for receiving end flange 88 of weathershed housing 76.

Mounting assembly 16 includes a top mounting plate 90 rigidly coupled to the upper end of surge arrester 12 via bolt 92 and to the upper end of insulator 14 via four bolts 96, and a bottom mounting plate 94 rigidly coupled to the lower end of surge arrester 12 via bolt 98 and to the lower end fitting 74 of insulator 14 via four bolts 99. Accordingly, top plate 90 and bottom plate 94 maintain surge arrester 12 substantially parallel to insulator 14 for enhancing the strength of surge arrester 12 due to the high mechanical strength of core member 70 of insulator 14.

Figure 2:
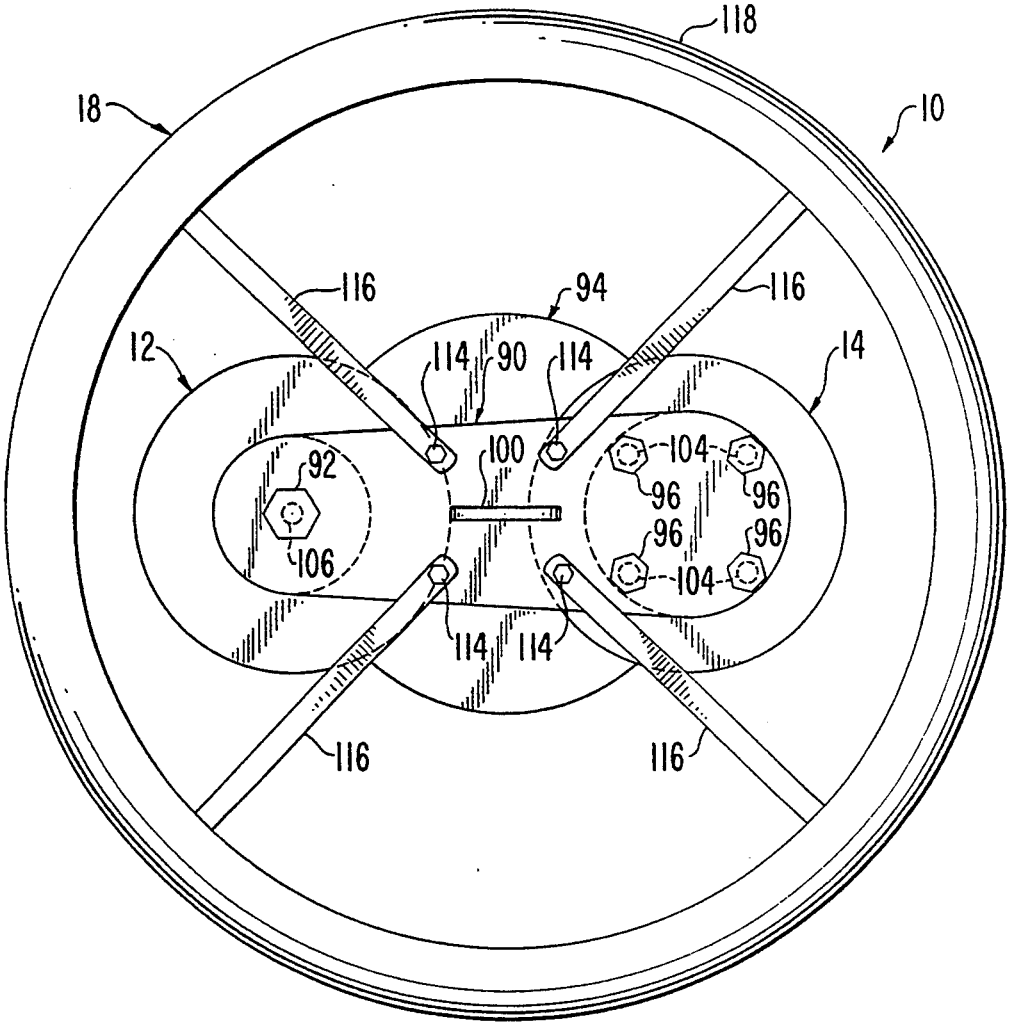
FIG. 2 is a top plan view of the electrical assembly illustrated in FIG. 1.

As seen in FIGS. 1 and 2, top plate 90 includes a conductor terminal flange 100 with four mounting holes 102 for coupling electrical assembly 10 to a high voltage line (not shown), four insulator mounting holes 104 positioned at one end of top plate 90 for coupling insulator 14 hereto via bolts 96, and a single surge arrester mounting hole 106 for coupling arrester 12 thereto via bolt 92. Preferably, top plate 90 is constructed of steel or aluminum, or any other conductive material with sufficient strength to form a rigid assembly between arrester 12 and insulator 14.

Specifically, bolts 96 are inserted through mounting holes 104 of top plate 90 and threaded into threaded bores 82 of upper end fitting 72 for fixedly and rigidly coupling the upper end of insulator 14 to top plate 90. Similarly, bolt 92 is inserted through mounting hole 106 and threaded into threaded bore 40 of end terminal 24, for fixedly and rigidly coupling the upper end of arrester 12 to top plate 90.

Figure 3:
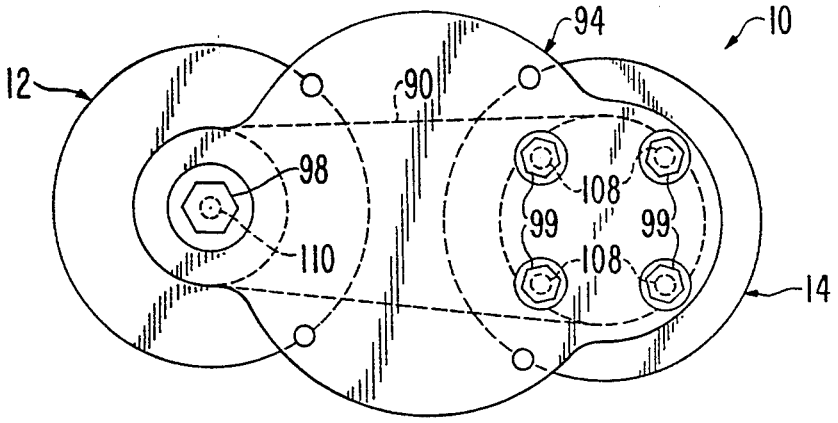
FIG. 3 is a bottom plan view of the electrical assembly illustrated in FIGS. 1 and 2.

As seen in FIGS. 1 and 3, bottom mounting plate 94 is a substantially flat plate with four insulator mounting holes 108 for coupling insulator 14 thereto via bolts 99, and a single arrester mounting hole 110 for coupling the lower end of surge arrester 12 thereto via bolt 98. Preferably, mounting holes 108 and 110 are countersunk so that the heads of the respective mounting bolts do not protrude from the bottom surface of mounting plate 94.

Specifically, bolts 99 are inserted through mounting holes 108 of bottom plate 94 and threaded into threaded bore 82 of lower end fitting 74 for rigidly and fixedly coupling the lower end of insulator 14 to bottom plate 94. Similarly, bolt 98 is inserted through mounting hole 110 and threaded into threaded bore 42 of end terminal 26 for fixedly and rigidly coupling arrester 12 to bottom plate 94.

Grading ring 18 is a conventional grading ring coupled to upper plate 90 via four threaded fasteners or bolts 114. Grading ring 18 includes four mounting rods 116 coupled to an annular ring 118. Preferably, grading ring 18 is constructed of a highly conductive metallic material. Grading rings, such as grading ring 18, are well known in the electrical art, and thus grading ring 18 will not be discussed in detail herein.

EXAMPLE

As mentioned above, the length of an arrester is determined by the voltage rating needed or desired for a particular application. In the case of either a vertically or horizontally mounted arrester used in a 230 kV system, a typical polymer surge arrester would be 85 inches in length. Assuming a polymer arrester has a 10,000 inch-pounds usable cantilever strength, the maximum load which could be applied at the free end of a vertically mounted polymer arrester would be approximately 117 pounds. However, this calculation does not take into account any load applied to such an arrester by wind.

Wind pressure on cylindrical surfaces such as the arrester are calculated using the following formula: Wind Pressure $(lb/ft^2)=0.00256$ (Velocity $mi/hr)^2$. If the design wind for the arrester is 150 mph, then the pressure applied to the arrester would be approximately 57.6 $lb/ft^2$.

A typical 85 inch, 230 kV arrester has a projected area of approximately 2.65 $ft^2$. Thus, the distributed load due to the wind on the arrester is approximately 153 pounds. The moment applied to the base of the arrester due to a 150 mph wind would be approximately 6,500 inch-pounds. This leaves a residual strength of approximately 41 pounds for any top end connecting pull off loads to be applied to the arrester. Forty-one pounds may not be enough residual strength for many applications. Also, if ice were a consideration, any increase in projected area of the arrester due to ice would need to be included in wind and load calculations.

If this 85 inch, 230 kV arrester were horizontally mounted, the weight of the arrester must also be considered. An arrester which is 85 inches in length will have a weight of approximately 160 pounds. The load due to weight is directed in the vertical direction, while the wind load may be considered to be directed 90° to the weight, i.e., in the horizontal direction. Thus, the cantilever load applied to the horizontally mounted arrester is the vector sum of the 153 pounds applied by the wind and 160 pounds applied by the weight of the arrester, which applies a 9,400 inch-pounds moment to the base of the arrester. This leaves only about 7 pounds for any top end pull of load and does not consider any increase in wind or weight load due to ice.

Thus, in both of these cases the vertically or horizontally mounted arrester will meet electrical requirements but not mechanical requirements. A polymer post insulator, such as insulator 14, of essentially the same dimensions as the arrester 12 has a usable strength of better than 100,000 inch-pounds. Accordingly, electrical assembly 10 enhances the strength of arrester 12 from approximately 10,000 inch-pounds to approximately 110,000 inch-pounds, since arrester 12 is rigidly coupled in parallel to insulator 14.

Electrical Assembly 210

Figure 11:
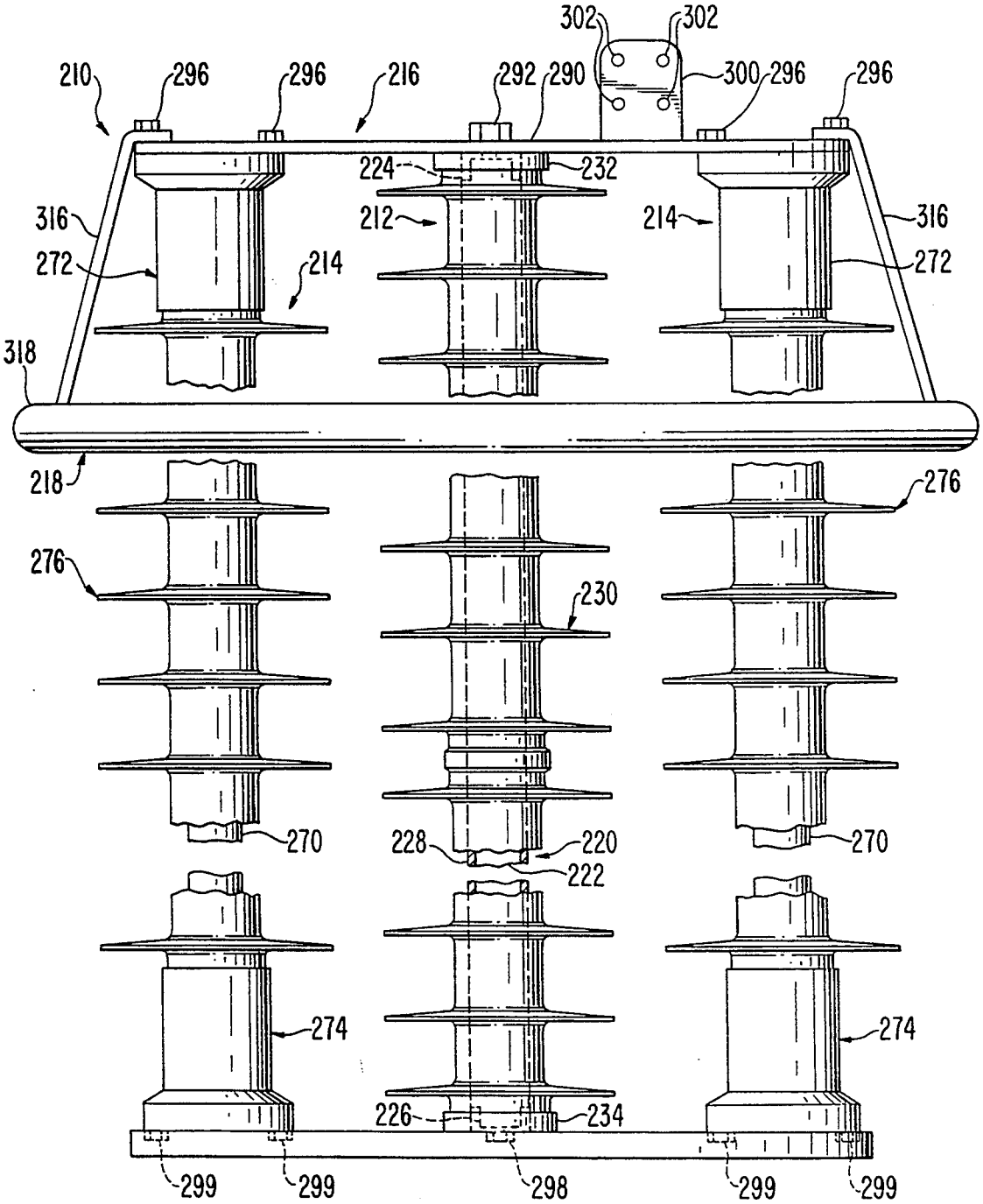
FIG. 11 is a side elevational view of an electrical assembly in accordance with a second embodiment of the present invention illustrating a pair of insulators mounted in parallel to a centrally located surge arrester.
Figure 12:
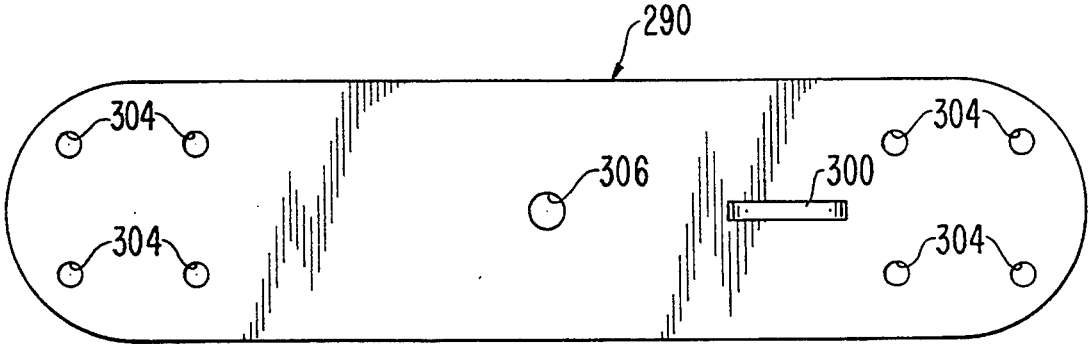
FIG. 12 is a top plan view of the mounting plate for the electrical assembly illustrated in FIG. 11.
Figure 13:
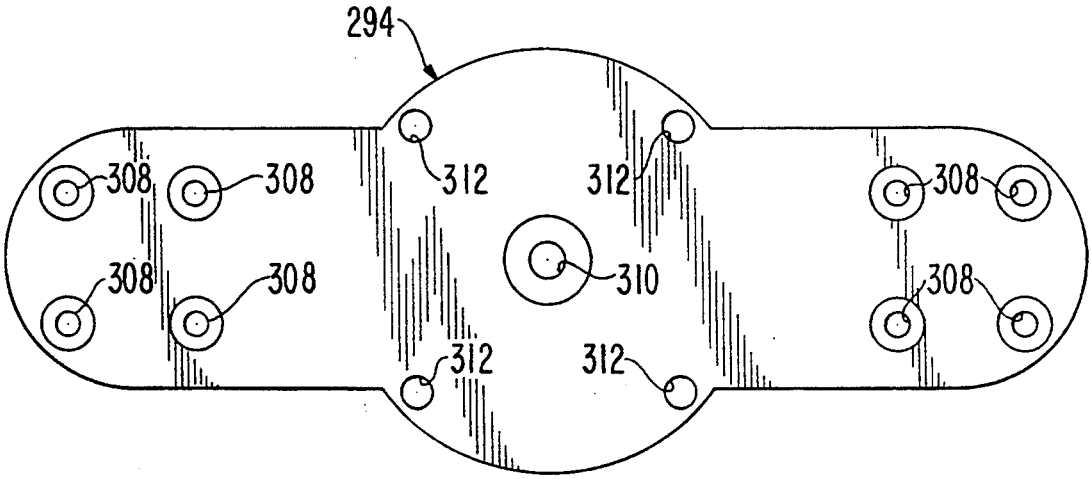
FIG. 13 is a bottom plan view of the mounting plate for the electrical assembly illustrated in FIG. 11.
Figure 14:
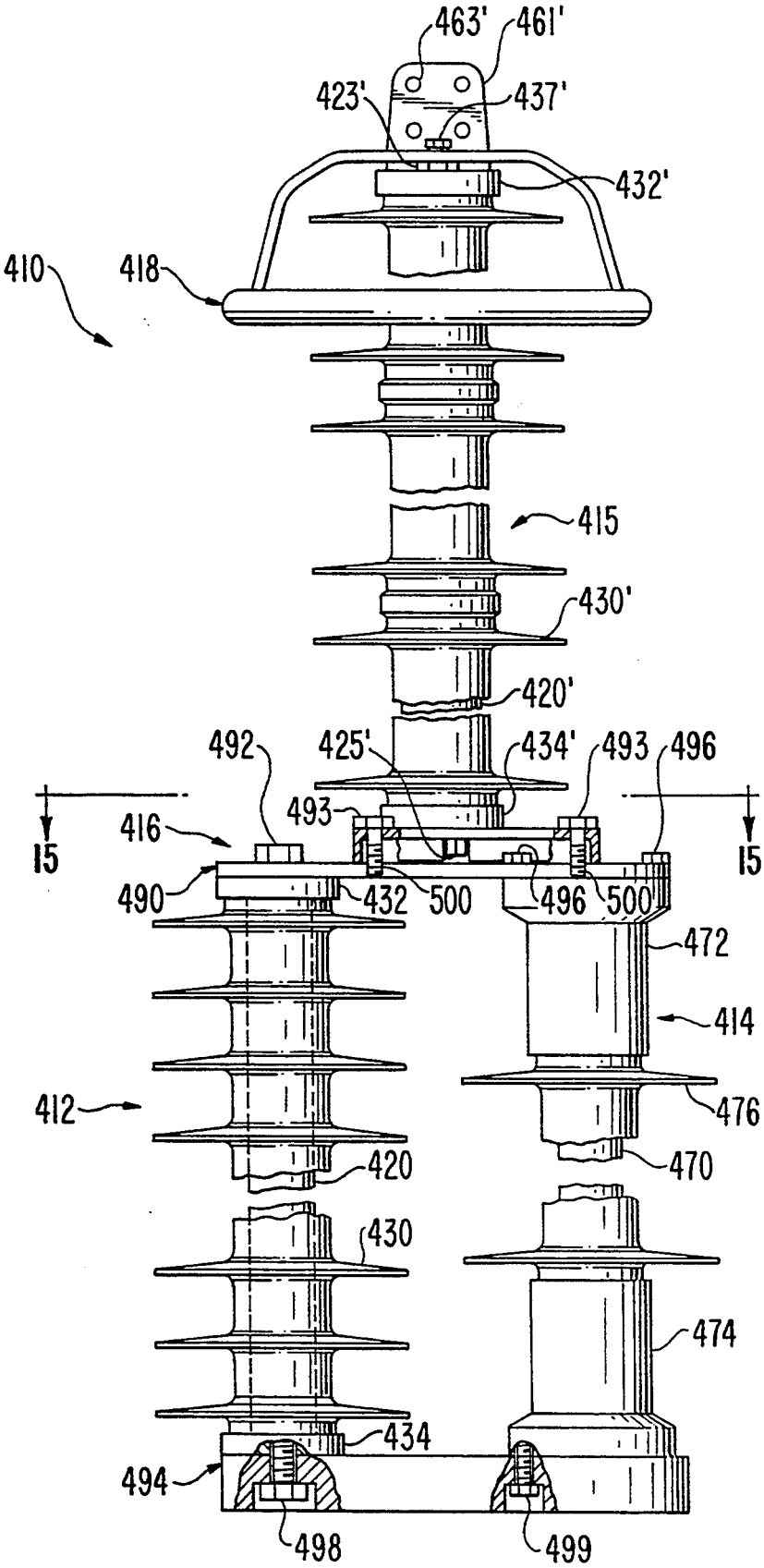
FIG. 14 is a side elevational view of an electrical assembly in accordance with a third embodiment of the present invention illustrating a pair of arresters mounted in series and an insulator mounted in parallel to the lower arrester.
Figure 15:
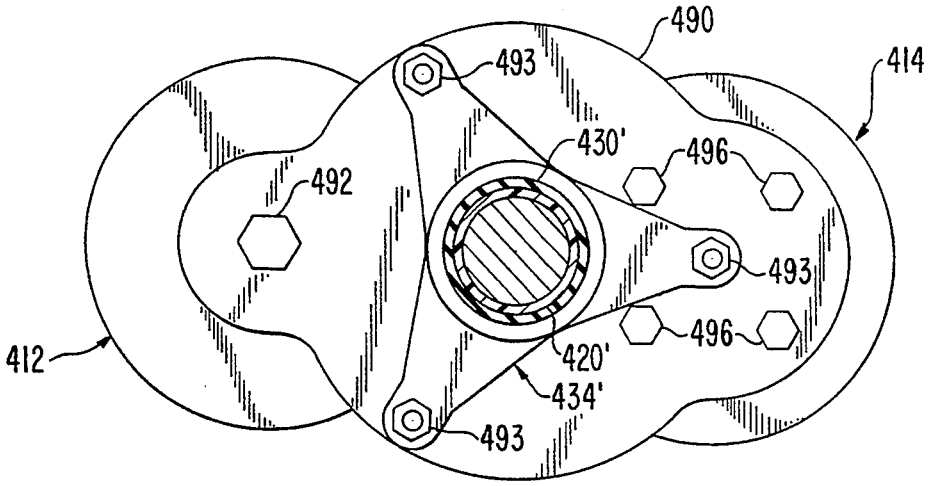
FIG. 15 is an enlarged cross-sectional view of the electrical assembly illustrated in FIG. 14 taken along section line 15—15.

Referring now to FIGS. 11–13, an electrical assembly 210 in accordance with a second embodiment of the present invention is illustrated, and includes a surge arrester 212, a pair of insulators 214, a mounting assembly 216 coupling surge arrester 212 parallel to insulators 214, and a grading ring 218 coupled to mounting assembly 216.

Surge arrester 212 and insulators 214 are substantially identical to surge arrester 12 and insulator 14, respectively, and thus surge arrester 212 and insulators 214 will not be discussed or illustrated in detail herein.

Surge arrester 212 includes a core member 220 formed of a plurality of non-linear resistive blocks 222 and a pair of end terminals 224 and 226 wrapped in a layer of non-conductive filament winding 228, a polymeric weathershed housing 230 overlying core member 220, and a pair of metallic end fittings 232 and 234 coupled to the ends of core member 220 and the ends of weathershed housing 230.

As seen in FIG. 11, insulator 214 includes an insulating core member 270, a first end fitting 272 coupled to the upper end of core member 270, a second end fitting 274 coupled to the lower end of core member 270, and an elastomeric weathershed housing 276 overlying and enclosing the portion of core member 270 between end fittings 272 and 274.

Mounting assembly 216 includes a top mounting plate 290 rigidly coupled to the upper end of surge arrester 212 via bolt 292 and to the upper ends of insulators 214 via two sets of four bolts 296, and a bottom plate 294 rigidly coupled to the lower end of surge arrester 212 via bolt 298 and to the lower end of insulators 214 via two sets of four bolts 299. Accordingly, top plate 290 and bottom plate 294 maintain surge arrester 212 substantially parallel to insulators 214. Insulators 214 enhance the strength of surge arrester 212 due to the high mechanical strength of core members 270 of insulator 214.

As seen in FIGS. 11 and 12, top plate 290 includes a conductor terminal flange 300 with four mounting holes 302 for coupling electrical assembly 210 to a high voltage line (not shown), two sets of four insulator mounting holes 304 with one set positioned at each end of top plate 290 for coupling insulator 214 thereto via bolts 296, and a single surge arrester mounting hole 306 for coupling arrester 212 via bolt 292. Preferably, top plate 290 is constructed of steel or aluminum or any other conductive material with sufficient strength to form a rigid assembly between arrester 212 and insulator 214.

Specifically, bolts 296 are inserted through mounting holes 304 of top plate 290 and threaded into threaded bores 282 of upper end fitting 272 for fixedly and rigidly coupling the upper end of insulator 214 to top plate 290. Similarly, bolt 292 is inserted through mounting hole 306 and threaded into threaded bore 240 of end terminal 224 for fixedly and rigidly coupling the upper end of arrester 212 to top plate 290.

As seen in FIGS. 11 and 13, bottom mounting plate 294 is a substantially flat plate with two sets of four insulator mounting holes 308 positioned at the ends of plate 294 for coupling insulator 214 thereto via bolts 299, a single arrester mounting hole 310 positioned in the center of bottom mounting plate 294 for coupling the lower end of surge arrester 212 thereto via bolt 298, and four ground mounting holes 312 or coupling electrical assembly 210 to a grounded support member (not shown). Preferably, mounting holes 308 and 310 are countersunk so that the heads of the respective bolts do not protrude from the bottom surface of mounting plate 294. Preferably, bottom plate 294 is constructed of steel or aluminum, or any other conductive material with sufficient strength to form a rigid assembly between arrester 212 and insulator 214.

Specifically, bolts 299 are inserted through mounting holes 308 of bottom plate 294 and threaded into threaded bore 282 of lower end fitting 274 for rigidly and fixedly coupling the lower ends of insulators 214 to bottom plate 294. Similarly, bolt 298 is inserted through mounting hole 310 and threaded into the threaded bore 242 of end terminal 226 for fixedly and rigidly coupling arrester 212 to bottom mounting plate 294. Grading ring 218 is a conventional grading ring which is coupled to upper plate 290 via four of the threaded fasteners or bolts 296. Grading ring 218 includes four mounting rods 316 (only two shown) coupled to an annular ring 318. Preferably, grading ring 218 is constructed of a highly conductive metallic material. Grading rings, such as grading ring 218, are well known in the electrical art, and thus grading ring 218 will not be discussed in detail herein.

Electrical Assembly 410

Referring now to FIG. 14–19, an electrical assembly 410 in accordance with a third embodiment of the present invention is illustrated, and includes a first or lower surge arrester 412, an insulator 414, a second or upper surge arrester 415, a mounting assembly 416 coupling first surge arrester 412 parallel to insulator 414 and in series to second arrester 415, and a grading ring 418 coupled to second arrester 415. In this embodiment, surge arrester 412 has a 29 kV rating, while surge arrester 415 has a 115 kV rating. Accordingly, the electrical assembly 410 has a total 144 kV rating, which is commonly used in 230 kV systems.

Surge arrester 412 is substantially identical to surge arrester 12, and thus surge arrester 412 will not be discussed or illustrated in detail herein. Surge arrester 415, on the other hand, is substantially identical to surge arrester 12, except for the end fittings 432' and 434' which have been modified to be mounted on top of surge arrester 412 and insulator 414. Accordingly, only the differences between surge arrester 415 and surge arrester 12 will be discussed in detail.

Preferably, surge arrester 412 includes a core member 420 formed of a plurality of non-linear resistive blocks and a pair of end terminals wrapped in a layer of non-conductive filament windings, a polymeric weathershed housing 430 overlying core member 420, and a pair of metallic end fittings 432 and 434 electrically coupled to the ends of core member 420 by bolts 492 and 498 and the ends of weathershed housing 430.

Preferably, surge arrester 415 includes a core member 420' formed of a plurality of non-linear resistive blocks and a pair of end terminals wrapped in a layer of non-conductive filament windings, a polymeric weathershed housing 430' overlying core member 420', and a pair of metallic end fittings 432' and 434' electrically coupled to the ends of core member 420' by bolts 423' and 425' and the ends of weathershed housing 430'.

Figure 18:
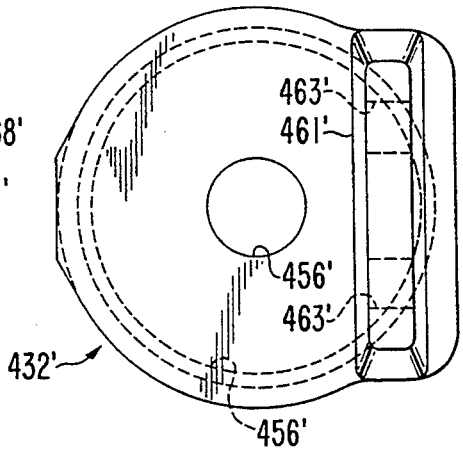
FIG. 18 is an enlarged, top plan view of the top plate or end fitting of the upper arrester with an integral terminal plate and a portion broken away for clarity.
Figure 16:
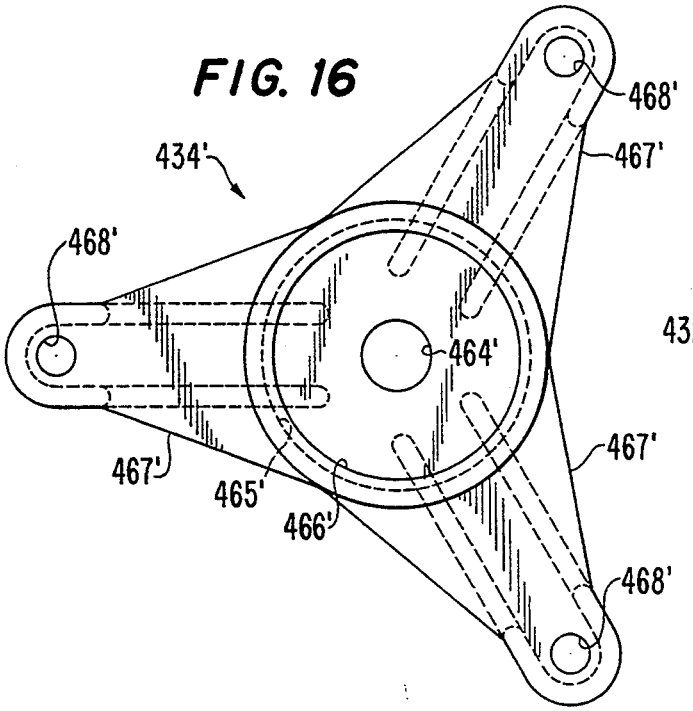
FIG. 16 is a top plan view of the bottom plate or end fitting of the upper arrester for coupling the upper arrester to the lower arrester and the insulator of the electrical assembly illustrated in FIGS. 14 and 15.
Figure 19:
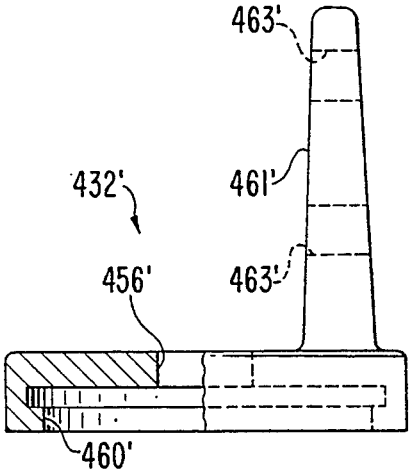
FIG. 19 is an enlarged, side elevational view of the top plate or end fitting illustrated in FIG. 18.
Figure 17:
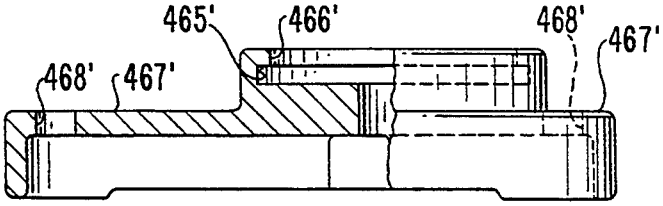
FIG. 17 is an enlarged elevational view of the bottom plate or end fitting of the upper arrester illustrated in FIG. 16 with a portion broken away for clarity.

As seen in FIGS. 16 and 17, lower end fitting 434' has an axially extending bore 464' for receiving bolt 425', an annular recess 465' for receiving an end flange of weathershed housing 430', an annular flange 466' for engaging the outer surface of weathershed housing 430' and three mounting legs 467' with a mounting hole 468' in each of the mounting legs 467' for receiving bolts 493 therein. As seen in FIGS. 18 and 19, upper end fitting 432' has an axially extending bore 456' for receiving bolts 423', an annular flange 460' for engaging the outer surface of weathershed housing 430' and an upwardly extending terminal flange 461' with four mounting holes 463'. Both end fittings 432' and 434' are coupled to the rest of arrester 415 in the same manner that end fittings 32 and 34 are coupled to the arrester 12 of the first embodiment. Thus, end fittings 432' and 434' will not be discussed in any greater detail.

Insulator 414 is substantially identical to insulator 14, and thus insulator 414 will not be discussed or illustrated in detail herein. Insulator 414 includes an insulating core member 470, a first end fitting 472 coupled to the upper end of core member 470, a second end fitting 474 coupled to the lower end of core member 470, and an elastomeric weathershed housing 476 overlying and enclosing the portion of core member 470 between end fittings 472 and 474.

Mounting assembly 416 includes a top mounting plate 490 for rigidly coupling the upper ends of surge arrester 412 and insulator 414 to the lower end of surge arrester 415, and a bottom mounting plate 494 for rigidly coupling the lower ends of surge arrester 412 and insulator 414 together. In particular, top mounting plate 490 is rigidly coupled to the upper end of surge arrester 412 via bolt 492 and to the upper end of insulator 414 via four bolts 496. Top mounting plate 490 is also coupled to the lower end of surge arrester 415 via three bolts 493. Bottom plate 494 is rigidly coupled to the lower end of surge arrester 412 via bolt 498 and to the lower end of insulator 414 via four bolts 499 (only one shown). Accordingly, top plate 490 and bottom plate 494 maintain surge arrester 412 substantially parallel to insulator 414 so that insulator 414 enhances the strength of surge arrester 412 due to the high mechanical strength of core member 470 of insulator 414. Top mounting plate 490 also couples the upper surge arrester 415 in series with lower surge arrester 412.

Top mounting plate 490 and lower mounting plate 494 are substantially identical to top mounting plate 90 and bottom mounting plate 94 of the first embodiment, except that top mounting plate 490 has three additional threaded holes 500 (only two shown in FIG. 14) for mounting the lower end fitting 434' to top mounting plate 490 via three screws 493. Accordingly, top mounting plate 490 and bottom mounting plate 494 will not be discussed or illustrated in detail herein.

Grading ring 418 is a conventional grading ring coupled to the upper end of arrester 415 via bolt 427' which is threaded into a threaded bore (not shown) formed in bolt 423'. Thus, grading ring 418 will not be discussed or illustrated in detail herein.

Electrical Assembly 510

Figure 20:
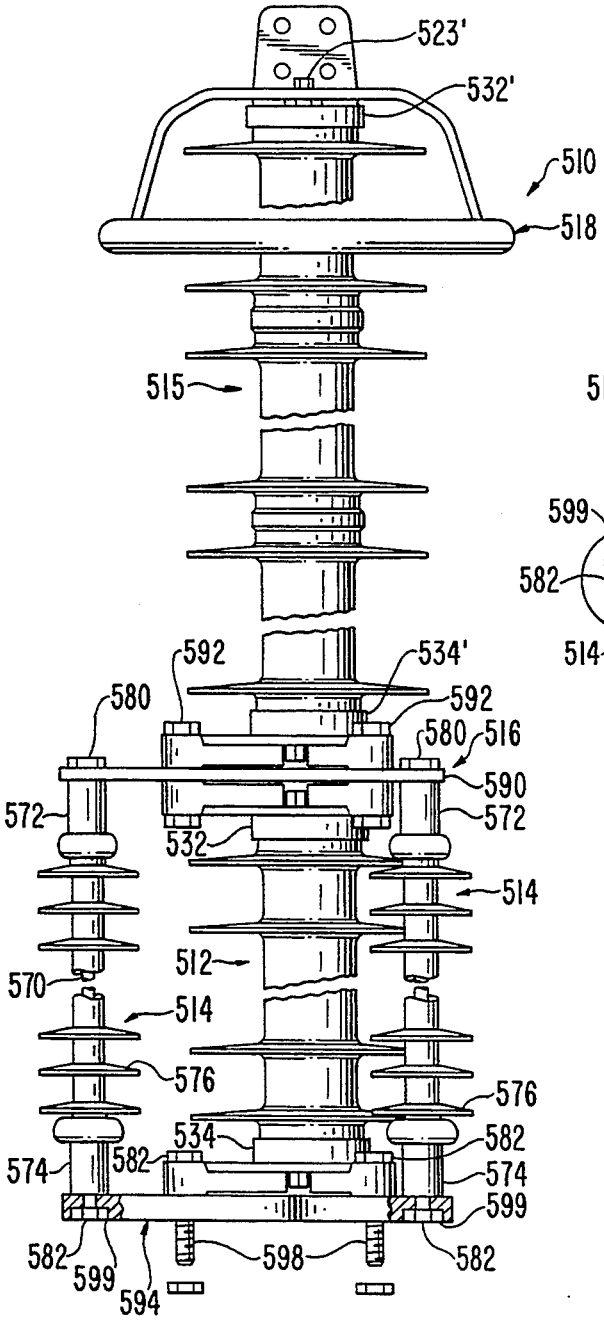
FIG. 20 is a side elevational view of an electrical assembly in accordance with a fourth embodiment of the present invention illustrating an upper arrester and a lower arrester mounted in series and three insulators mounted in parallel to the lower arrester.
Figure 21:
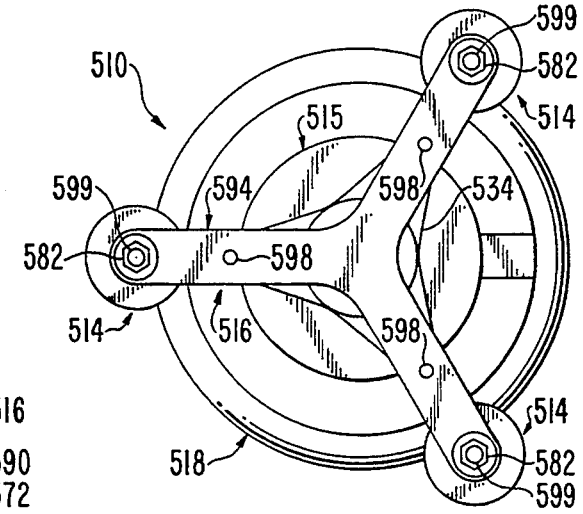
FIG. 21 is a bottom plan view of the electrical assembly illustrated in FIG. 20.

Referring now to FIGS. 20 and 21, an electrical assembly 510 in accordance with a fourth embodiment of the present invention is illustrated, and includes a first or lower surge arrester 512, three insulators 514, a second or upper surge arrester 515, a mounting assembly 516 coupling first surge arrester 512 parallel to the three insulators 514 and in series to second arrester 515, and a grading ring 518 coupled to the top of second arrester 515.

Surge arrester 512 and 515 are substantially identical to surge arrester 12, except for the end fittings which have been modified. Moreover, the end fittings 532' and 534' of surge arrester 515 are substantially identical to end fittings 432' and 434' of the surge arrester 415 of the third embodiment, while the end fittings 532 and 534 of surge arrester 512 are both substantially identical to end fitting 434' of surge arrester 415 as well as substantially identical to end fitting 534'. Thus, surge arrester 512 and 515 will not be discussed or illustrated in detail herein.

In this embodiment, surge arrester 512 is a 29 kV rating, while surge arrester 515 has a 115 kV rating. Accordingly, the electrical assembly 510 has a total 144 kV rating, which is commonly used in 230 kV systems.

Insulators 514 are substantially identical to insulator 14, and thus insulator 514 will not be discussed or illustrated in detail herein. Each of the insulators 514 includes an insulating core member 570, a first end fitting 572 coupled to the upper end of core member 570, a second end fitting 574 coupled to the lower end of core member 570, and an elastomeric weathershed housing 576 overlying and enclosing the portion of core member 570 between end fittings 572 and 574. End fittings 572 and 574 are coupled to mounting assembly 516 via bolts 580 and 582, respectively.

Mounting assembly 516 includes a top mounting plate 590 for rigidly coupling the upper end of surge arrester 512 and the upper ends of the three insulators 514 to the lower end of surge arrester 515 and a bottom mounting plate 594 for rigidly coupling the lower end of surge arrester 512 and the lower ends of the three insulators 514 together. In particular, top mounting plate 590 is rigidly coupled to the upper end of surge arrester 512 via three bolts 592 (only two shown) and to the upper ends of insulators 514 via three bolts 580 (only two shown). Top mounting plate 590 is also coupled to the lower end of surge arrester 515 via the same three bolts 592 used to couple surge arrester 512 to top plate 590. Bottom plate 594 is rigidly coupled to the lower end of surge arrester 512 via three bolts 598 (only two shown) and to the lower ends of insulator 514 via three bolts 582. Bolts 598 are also used to couple the entire electrical assembly 510 to a support structure (not shown) in a conventional manner. Top plate 590 is substantially identical to bottom plate 592, except that bottom plate 592 is thicker than top plate 590 and has three recesses 599 for receiving the heads of bolts 582 therein.

Accordingly, top plate 590 and bottom plate 594 maintain surge arrester 512 substantially parallel to insulators 514 so that insulators 514 enhances the strength of surge arrester 512 due to the high mechanical strength of the core members 570 of insulator 514. Top mounting plate 590 also couples the upper surge arrester 515 in series with lower surge arrester 512.

Grading ring 518 is a conventional grading ring coupled to the upper end of arrester 515 via bolt 523'. Thus, grading ring 518 will not be discussed or illustrated in detail herein.

It will be apparent to those skilled in the art from the subject disclosure that a plurality of insulators and/or arresters can be coupled in parallel between a pair of mounting plates so that the insulators enhance the strength of the arresters. For example, a single arrester by itself, or mounted in series with another arrester, could be centrally located between a pair of mounting plates and four or more insulators could be coupled in parallel so as to surround the arrester.

While only four embodiments have been chosen to illustrate the invention, it will be understood by those skilled in the art that various changes and modifications can be made herein without departing from the scope of the invention as described in the appended claims.

What is claimed is:

1. An electrical assembly, the combination comprising:

a first surge arrester having a core member, a weathershed housing surrounding said core member, a first end fitting coupled to one end of said core member, a second end fitting coupled to the other end of said core member, and a first longitudinal axis extending between said first and second end fittings;

a first electrical insulator having an insulated core member, a weathershed housing surrounding said core member of said insulator, a first end fitting coupled to one end of said core member of said insulator, a second end fitting coupled to the other end of said core member of said insulator, and a second longitudinal axis extending between said first and second end fittings of said insulator; and coupling means, coupled to said arrester and said insulator, for mounting said insulator substantially adjacent to said arrester with said first longitudinal axis of said arrester being arranged substantially parallel to and spaced from said second longitudinal axis of said insulator so that said core members of said arrester and said insulator are spaced apart.

2. An electrical assembly according to claim 1, wherein said core member of said arrester includes a plurality of non-linear resistive blocks stacked along said first longitudinal axis.

3. An electrical assembly according to claim 2, wherein said weathershed housing of said arrester is formed of a polymeric material.

4. An electrical assembly according to claim 1, wherein said core member of said insulator is a reinforced fiberglass rod.

5. An electrical assembly according to claim 4, wherein said weathershed housing of said insulator is formed of a polymeric material.

6. An electrical assembly according to claim 1, wherein said coupling means includes a first mounting means for coupling one end of said arrester to one end of said insulator, and second mounting means for coupling the other end of said arrester to the other end of said insulator.

7. An electrical assembly according to claim 6, wherein each of said first and second mounting means includes a base member, a first fastening means for coupling said base member to said arrester, and a second fastening means for coupling said base member to said insulator.

8. An electrical assembly according to claim 7, further comprising a second insulator having an insulated core member, a weathershed housing surrounding said core member of said second insulator, a first end fitting coupled to one end of said core member of said second insulator, a second end fitting coupled to the other end of said core member of said second insulator, and a third longitudinal axis extending between said first and second end fittings of said second insulator, and said each of said first and second mounting means includes third fastening means for coupling said first and second end fittings of said second insulator to said base members, respectively, to maintain said third longitudinal axis of said second insulator parallel to said first longitudinal axis of said arrester.

9. An electrical assembly according to claim 8, wherein said arrester is positioned between said first and second insulators.

10. An electrical assembly according to claim 9, wherein each of said first fastening means includes a threaded bolt which extends through a hole in one of said base members and is threaded into a threaded bore formed in one of said ends of said arrester.

11. An electrical assembly according to claim 10, wherein each of said second fastening means includes at least one threaded bolt which extends through a hole in one of said base members and is threaded into a threaded bore formed in the other of said ends of said first and second insulators.

12. An electrical assembly according to claim 11, wherein said core member of said arrester includes a plurality of non-linear resistive blocks stacked along said first longitudinal axis.

13. An electrical assembly according to claim 12, wherein said weathershed housing of said arrester is formed of a polymeric material.

14. An electrical assembly according to claim 11, wherein said core member of said insulator is a reinforced fiberglass rod.

15. An electrical assembly according to claim 14, wherein said weathershed housing of said insulator is formed of polymeric material.

16. An electrical assembly according to claim 11, wherein said coupling means includes first mounting means for coupling one end of said arrester to said insulator, and a second mounting means for coupling the other end of said arrester to said insulator.

17. An electrical assembly according to claim 1, further comprising:

a second arrester with an upper end and a lower end coupled in series to said first arrester by said coupling means.

18. An electrical assembly according to claim 17, wherein said coupling means includes a first mounting means for coupling one end of said first arrester to one end of said insulator and to said lower end of said second arrester, and second mounting means for coupling the other end of said first arrester to said insulator.

19. An electrical assembly according to claim 18, wherein each of said first and second mounting means includes a base member, a first fastening means for coupling said base member to said first arrester, and a second fastening means for coupling said base member to said insulator; and said first mounting means further includes third fastening means for coupling said base member of said first mounting means to said second arrester.

20. An electrical assembly according to claim 19, further comprising a second insulator having an insulated core member, a weathershed housing surrounding said core member of said second insulator, a first end fitting coupled to one end of said core member of said second insulator, a second end fitting coupled to the other end of said core member of said second insulator, and a third longitudinal axis extending between said first and second end fittings of said second insulator, and each of said first and second mounting means includes fourth fastening means for coupling said first and second end fittings of said second insulator to said base members, respectively, to maintain said third longitudinal axis of said second insulator parallel to said first longitudinal axis of said arrester.

21. An electrical assembly according to claim 20 wherein said first arrester is positioned between said first and second insulators.

22. An electrical assembly according to claim 21, further comprising a third electrical insulator having an insulated core member, a weathershed housing surrounding said core member of said third insulator, a first end fitting coupled to one end of said core member of said third insulator, a second end fitting coupled to the other end of said core member of said third insulator, and a fourth longitudinal axis extending between said first and second end fittings of said third insulator, and each of said first and second mounting means includes fifth fastening means for coupling said first and second end fittings of said third insulator to said base members, respectively, to maintain said fourth longitudinal axis of said third insulator parallel to said first longitudinal axis of said first arrester.

23. An electrical assembly, the combination comprising:

a first surge arrester having a core member, a first end fitting coupled to one end of said core member, a second end fitting coupled to the other end of said core member, and a first longitudinal axis extending between said first and second end fittings;

a first electrical insulator having an insulated core member, a first end fitting coupled to one end of said core member of said insulator, a second end fitting coupled to the other end of said core member of said insulator, and a second longitudinal axis extending between said first and second end fittings of said insulator; and a pair of mounting members rigidly coupled to said arrester and said insulator for mounting said insulator substantially adjacent to said arrester with said first longitudinal axis of said arrester being arranged substantially parallel to and spaced from said second longitudinal axis of said insulator.

24. An electrical assembly according to claim 23, wherein said core member of said arrester including a plurality of non-linear resistive blocks stacked along said first longitudinal axis.

25. An electrical assembly according to claim 24, wherein said arrester has a weathershed housing formed of a polymeric material.

26. An electrical assembly according to claim 24, wherein said core member of said insulator is a reinforced fiberglass rod.

27. An electrical assembly according to claim 26, wherein said arrester and said insulator each has a weathershed housing formed of a polymeric material.

28. An electrical assembly according to claim 26, wherein one of said mounting member is coupled to said first end fittings of said arrester and said insulator, and the other of said mounting member is coupled to said second end fittings of said arrester and said insulator.

* * * * *